United States Patent [19]
Flanders
[11] Patent Number: 4,462,132
[45] Date of Patent: Jul. 31, 1984

[54] SHOE UPPER CONFORMING MACHINE

[75] Inventor: James R. Flanders, Blaby, England
[73] Assignee: USM Corporation, Farmington, Conn.

[21] Appl. No.: 316,980
[22] Filed: Nov. 2, 1981
[30] Foreign Application Priority Data
Nov. 7, 1980 [GB] United Kingdom ..... 8035768
[51] Int. Cl.³ ..... A43D 21/00; A43D 23/00
[52] U.S. Cl. ..... 12/85; 12/10.1; 12/12; 12/14.4
[58] Field of Search ..... 12/8.5, 8.6, 10.1, 10.2, 12/10.4, 14.4, 12, 12.1

[56] References Cited
U.S. PATENT DOCUMENTS
4,296,513 10/1981 Harford et al. ..... 12/12
FOREIGN PATENT DOCUMENTS
WO82/01302 4/1982 PCT Int'l Appl. ..... 12/12

*Primary Examiner*—Werner H. Schroeder
*Assistant Examiner*—Steven N. Meyers
*Attorney, Agent, or Firm*—Donald N. Halgren

[57] ABSTRACT

Side lasting machine has a last support and two side lasting assemblies each comprising a plurality of lasting fingers, a plurality of clamp pads arranged beneath the fingers, one associated with each pair of fingers, and, depending from each finger and interposed between the pads and the upper, a plurality of lasting bands. Each band extends over the width of not less than two fingers; preferably in the region of the two most heelwardly disposed pairs, a single band is provided. Each pad is mounted for independent pivotal movement about a vertical axis, to enable it to conform more readily to the last contour. The pads hold the bands against the upper under a pressure sufficient to allow slipping therebetween, the band thus applying an updrafting force to the upper as the fingers move inwardly.

6 Claims, 2 Drawing Figures

SHOE UPPER CONFORMING MACHINE

BACKGROUND OF THE INVENTION (1) Field of the Invention

This invention is concerned with a shoe upper conforming machine for use in lasting side portions of shoe uppers. The term "shoe" where used herein is used generically as indicating articles of outer footwear generally including such articles in the course of manufacture.

(2) Prior Art

It has recently been proposed to provide a shoe upper conforming machine for use in lasting side portions of shoe uppers comprising a support for a shoe last on which an upper, the side portions of which are to be lasted, and an insole are positioned, and two side lasting assemblies arranged so as to act on opposite side portions of an upper positioned on a last supported by said support, wherein each side lasting assembly comprises clamping means, comprising at least one clamp member, movable towards the last support to cause a side portion of the upper to be held against the last, on which it is positioned and which is supported by the last support, at a locality spaced from the featherline thereof, and lasting band means comprising at least one upper-engaging band portion of flexible sheet material arranged to be interposed between the shoe upper and the clamp member(s), and further wherein the or each upper-engaging band portion is held by the clamp member(s), in the operation of the machine, against the upper positioned on its last under a pressure which does not prevent movement of the upper-engaging band portion(s) relative to the clamp member(s) but which is sufficient to cause such movement of said portions(s) to apply a drafting force to the portion of the upper engaged thereby, the arrangement being such that, in the operation of the machine, movement of the upper-engaging band portion(s) is caused to take place relative to the clamp member(s) whereby a drafting force is applied to the upper by said portion(s) heightwise of the last in the direction of the featherline of the shoe, and lasting marginal portions of the side portion of the upper are caused to be wiped over corresponding marginal portions of the insole and be pressed thereagainst. In this way, a controlled drafting force can be applied to the upper through the upper-engaging band portion(s) the control being specifically achieved by the action of the clamp member(s) acting on the band portion(s).

The locality of the last at which the or each clamp member is caused to press the side portion of the upper may be relatively flat, so that no difficulty arises in applying adequate pressure to the lasting band(s) by the clamp member(s). Where, however, the last in said locality has a significant lengthwise contour, it has been found that, even though a plurality of independently operable clamp members may be used, the pressure applied thereby may be inadequate because the whole of the pressure-applying surface is not in contact with the band portion. This is especially the case where the lasting band means comprises a plurality of band portions arranged in pairs, each such pair being held in pressing engagement with the upper by one of the clamp members as aforesaid. This leads to inadequate drafting force being applied to the upper.

It is thus one of the various objects of the present invention to provide a side lasting machine in which the application of a controlled drafting force to the upper, using lasting band means pressed against the upper on its last by means of a plurality of clamp members, can be more reliably achieved.

BRIEF SUMMARY OF THE INVENTION

The invention provides, in one of its several aspects, a shoe upper conforming machine for use in lasting side portions of shoe uppers comprising a support for a shoe last on which an upper, the side portions of which are to be lasted, and an insole are positioned, and two side lasting assemblies arranged so as to act on opposite side portions of an upper positioned on a last supported by said support, wherein each side lasting assembly comprises clamping means, comprising a plurality of clamp members movable independently towards the last support to cause a side portion of the upper to be held against the last, on which it is positioned and which is supported by the last support, at localities spaced from the featherline thereof, and lasting band means comprising at least one upper-engaging band portion of flexible sheet material arranged to be interposed between the shoe upper and the clamp members, the or each upper-engaging band portion being held by the clamp members, in the operation of the machine, against the upper positioned on its last under a pressure which does not prevent movement of the upper-engaging band portions(s) relative to the clamp members but which is sufficient to cause such movement of said portion(s) to apply a drafting force to the portion of the upper engaged thereby, the arrangement being such that, in the operation of the machine, a drafting force is applied to the upper by said portion(s) heightwise of the last in the direction of the featherline of the shoe and lasting marginal portions of the upper are caused to be wiped over corresponding marginal portions of the insole and be pressed thereagainst, wherein each clamp member is mounted for pivotal movement about an axis extending heightwise of the last.

It will thus be appreciated that, using a machine in accordance with the invention, the clamp members can more readily conform to the lengthwise contour of the side of the last, and thereby more reliably cause the desired drafting force to be applied to the upper by the upper-engaging band portion(s) held against the upper by the clamp members.

It will be appreciated that the position of the axis in relation to the clamp member body and also the cross-sectional shape of each clamp member, viewed along said axis, should be such as to enable pivoting to take place without adjacent clamp members binding on one another, while still providing a suitable pressing surface for engagement with the band portion(s).

In the machine which has recently been proposed, as mentioned above, the lasting band means of each side lasting assembly comprises a plurality of band portions, arranged in pairs and each pair being associated with one clamp member, each clamp member thus being arranged to hold two band portions in pressing engagement with the upper as aforesaid. Furthermore, in said machine, each side lasting assembly further comprises lasting element means, comprising a plurality of lasting elements arranged side-by-side and movable inwardly towards the last support so as to cause lasting marginal portions of the side portion of the upper to be wiped over corresponding marginal portions of the insole and be pressed thereagainst, the inward movement of the lasting elements towards the last support as aforesaid being effective to cause movement of the upper-engaging band portions to take place relative to the clamp members whereby a drafting force is applied to the upper by said portions heightwise of the last as aforesaid.

It has, however, been found that using such an arrangement pleats may form in the wiped over lasting marginal portions of the upper, such pleats being formed, in the operation of the machine, in the region of gaps between adjacent band portions and their associated lasting elements.

It is thus another object of the present invention to provide a side lasting machine in which the lasting element means of each side lasting assembly comprises a plurality of lasting elements arranged side-by-side, but in the operation of which the risk of pleats in the wiped over lasting marginal portions of the upper is mitigated.

The invention thus also provides, in another of its several aspects, a shoe upper conforming machine for use in lasting side portions of shoe uppers comprising a support for a shoe last on which an upper, the side portions of which are to be lasted, and an insole are positioned, and two side lasting assemblies arranged so as to act on opposite side portions of an upper positioned on a last supported by said support, wherein each side lasting assembly comprises lasting element means, comprising a plurality of lasting elements arranged side-by-side and movable inwardly towards the last support so as to cause lasting marginal portions of the side portion of the upper to be wiped over corresponding marginal portions of the insole and be presssed thereagainst, and lasting band means of flexible sheet material held under tension by resilient means and arranged to be interposed between the shoe upper and the lasting elements, the arrangement being such that as inward movement of the lasting elements towards the last support is effected as aforesaid, the lasting band means is drawn heightwise of the last, in a direction of the featherline thereof, and also about the featherline region, thus to assist in wiping the lasting marginal portions of the upper over corresponding marginal portions of the insole and in pressing them thereagainst, wherein the lasting band means of each side lasting assembly comprises at least one upper-engaging band portion, and wherein the or each band portion is interposed as aforesaid between the upper and not less than two adjacent lasting elements.

In the machine as recently proposed, the lasting element means of each side lasting assembly comprises eight lasting elements, arranged in pairs, and each pair has associated therewith a clamp member. Furthermore, said machine comprises operator-actuatable selector means whereby any one pair of lasting elements and its associated clamp member may be rendered inoperative. In such a machine, therefore, it is desirable that the lasting band means of each side lasting assembly comprises four band portions, one associated with each pair of lasting elements. However, for a particular application, it may be desired to omit the selector means, in which case a single lasting band portion may be provided for co-operating with all the lasting elements of the side lasting assembly. Again, it is likely that the two most heelwardly disposed pairs of lasting elements will operate together, and a further lasting band means arrangement may thus comprise a single band portion extending across the width of said two most heelwardly disposed pairs of lasting elements, while separate band portions are provided associated with each of the other two pairs.

It will be appreciated that by provided a single band portion extending beyond the width of one lasting element, such band portion serves to fill the gap which may arise between adjacent lasting elements, with a result that pleating of the wiped lasting marginal portions of the upper in that region is prevented. Of course, in cases where the lasting band means comprises more than one band portion, necessarily a compromise arises, such compromise being dictated by the requirements of use of the machine: for example, where the machine operates on a range of sizes, the two most heelwardly disposed pairs of lasting elements may suffice to last the whole of the side portion, while with a larger shoe it may be necessary for three or four pairs of lasting elements to be used to effect a comparable lasting operation.

As previously mentioned, the or each upper-engaging band portion is held under tension by resilient means, said means being connected to one end of the or each band portion. The opposite end of the or each band portion is connected to its associated lasting elements so that inward movement of the lasting element means as aforesaid is effective to draw the lasting band portion(s) heightwise of the last and inwardly over the feather region thereof as aforesaid.

BRIEF DESCRIPTION OF THE DRAWINGS

The various objects and several aspects of the invention will become clearer from the following detailed description, to be read with reference to the accompanying drawings, of one machine in accordance with the invention, this machine having been selected for description merely by way of exemplification of the invention and not by way of limitation thereof.

In the accompanying drawings

DESCRIPTION OF THE PREFERRED EMBODIMENTS

Figure 1:
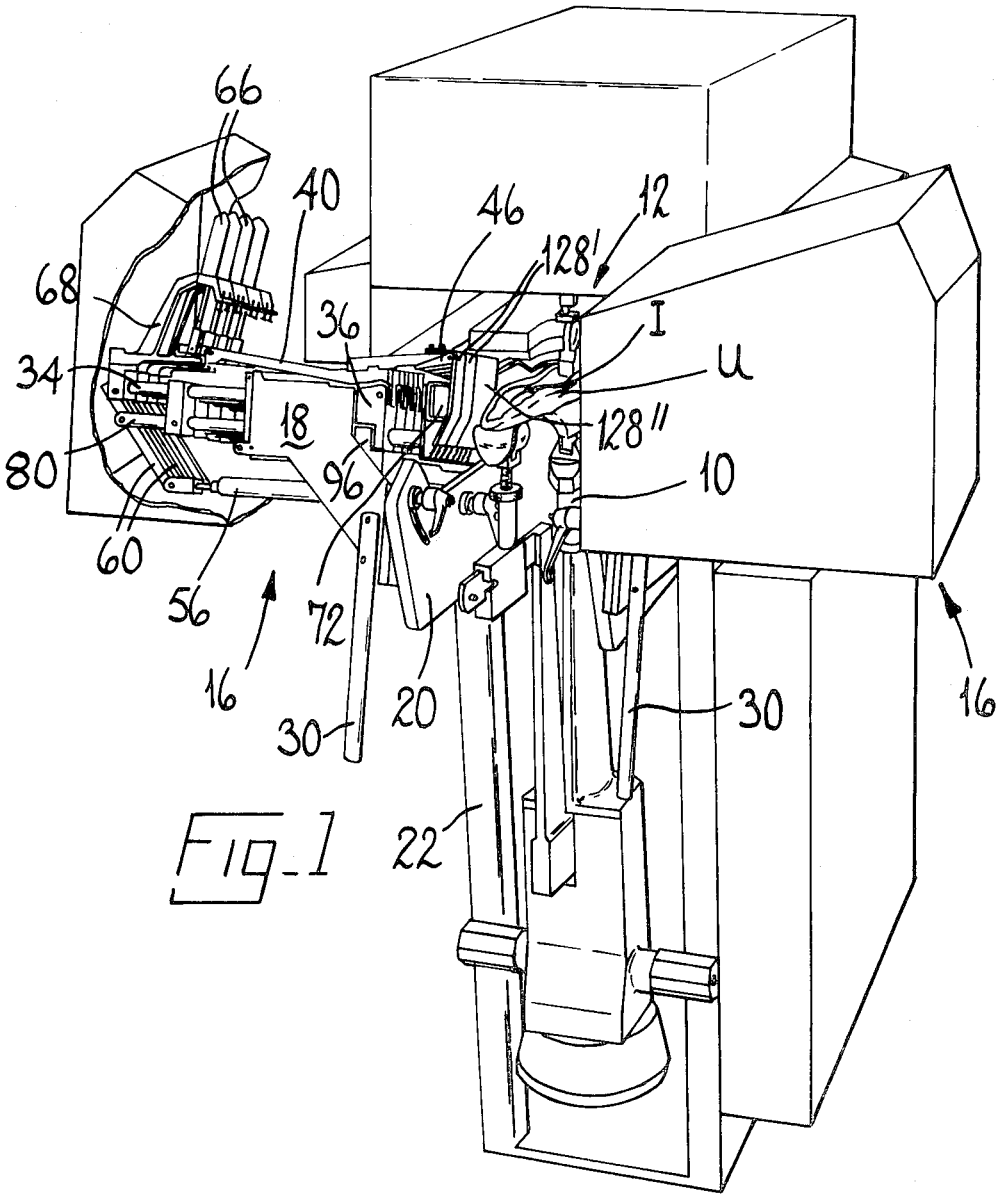
FIG. 1 is a front perspective view of the machine in accordance with the invention.
Figure 2:
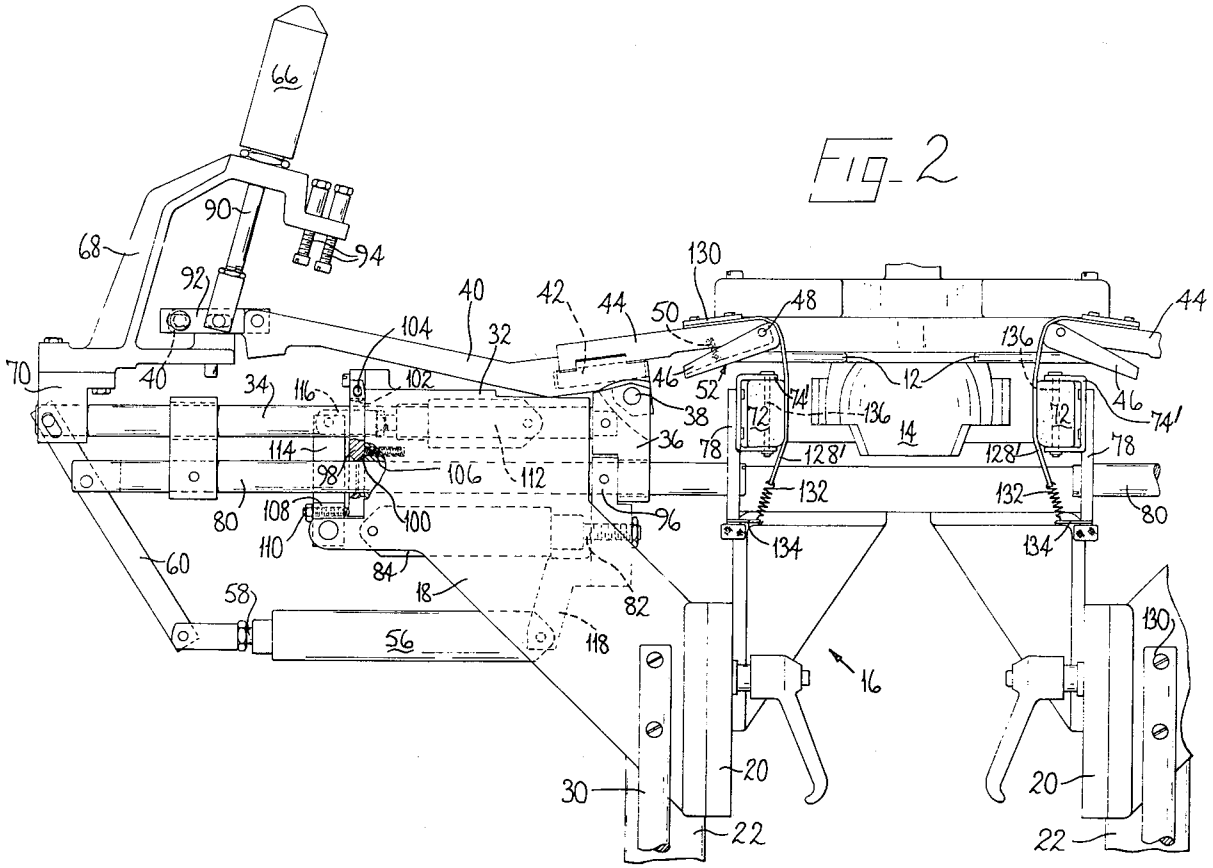
FIG. 2 is a view in front elevation, showing details of a left-hand side lasting assembly of said machine.

The machine in accordance with the invention now to be described is a combined heel seat and side last machine comprising a last support 10 on which a last can be supported, bottom uppermost, with an insole I located on the bottom thereof and a shoe upper U positioned thereon, as shown in FIG. 1. The machine further comprises heel seat wiping instrumentalities 12 and a heel band 14, shown in FIG. 2, and also two side lasting assemblies generally designated 16, arranged forwardly of the heel seat lasting instrumentalities, one at either side of the last support 10. The side lasting assemblies are mirror-opposites of one another and the left-hand assembly will be described with reference to FIG. 2.

The side lasting assembly 16 comprises a sub-frame 18 carried on a forwardly extending plate 20 mounted on a main machine frame 22 by pin-and-slot connections whereby the side lasting assembly 16 can pivot bodily about an axis extending transversely of the machine through a leading edge of the heel seat wipers 12 when in their advanced condition. For pivoting the sub-frame, a handle 30 is provided on the front thereof.

Forming part of the sub-frame 18 is a block 32 which accommodates four push-rods 34 for sliding movement in a direction transversely of the bottom of a last L carried by the last support 10, said rods being arranged side-by-side fore-and-aft of the machine. Mounted at the end, near the last support 10, of each push-rod 34 is a block 36 carrying a pivot pin 38 which extends fore-and-aft of the machine and on which a pair of levers 40 are each supported for pivotal movement. Each lever 40 supports a further pivot pin 42, extending transversely of the machine, and carrying an arm 44 which supports a lasting element 46. Each side lasting assembly 16 thus comprises eight such lasting elements. Each element 46 is carried by a pivot pin 48 mounted in the arm 44, the axis of said pin extending fore-and-aft of the machine. A spring 50 urges the lasting element downwardly about the pin 48 (counterclockwise, viewing FIG. 2). The lasting element 46 has a flat pressure-applying surface 52, while the end of said element facing the last support 10 is rounded at its top and bottom.

It will be appreciated that each block 36 thus carries two lasting elements 44, each independently pivotable about its own pin 42. Furthermore, it is to be noted that, when the pressure-applying surface 52 is horizontal, the axis of the pin 42 lies in the plane of said surface.

For urging each lever 40 about its pin 38, furthermore, four piston-and-cylinder arrangements 66 are provided, each acting on two associated levers 40 and each being carried by a bracket 68 carried on a mounting 70 secured to a rearward end of its associated push-rod 34. In each pair of levers 40 one is shorter than the other and there is provided, pivotally connected to the shorter lever and connected by a pin-and-slot connection to the longer lever, a link 92 itself connected by a pin-and-slot connection to a piston rod 90 of its associated piston-and-cylinder arrangement 66. In this manner, the levers 40 can be pivoted about the pin 38 independently of one another using a single piston-and-cylinder arrangement. The amount of movement in a clockwise direction of each lever is determined by a stop pin 94 carried by the bracket 68.

Mounted in the block 32, one beneath each of the push-rods 34, are four further push-rods 80. At the end, nearer the last support 10, of each push-rod 80 is secured a plate 78 to which is in turn secured a C-shaped bracket 74', between the arms of which is secured a pivot pin 136, on which is freely pivotable a clamp pad 72 of polyurethane material. The polyurethane material has a Shore A hardness of 70. The position of the pin 136 and the cross-sectional shape, viewed in plan, of each pad 72 is such that pivoting movement of each pad can take place, independently of the other pads, without adjacent pads binding on one another.

Also mounted adjacent said end of each push-rod 80 is a block 96 which is connected to a piston rod 82 of a piston-and-cylinder arrangement 84, there being four such arrangements 84 each pivotally mounted on the sub-frame 18. Furthermore, each block 96 is arranged to be in engagement, in the rest condition of the machine, with a face of a depending portion of its associated block 36. Thus, when each piston-and-cylinder arrangement 84 is operated, the push-rod 80 associated therewith is moved inwardly to move the clamp pad 72 inwardly towards the last support and, by engagement of the block 96 with the block 36, the wiping elements 46 associated with said pad are moved inwardly also.

At the end of the inward movement of each clamp pad 72, locking means is actuated to lock the push-rod 80 in position, said locking means comprising an apertured plate 98 through a restricted aperture 100 of which passes the push-rod 80 (and through a larger aperture 102 of which passes the push-rod 34). Each plate 98 is pivoted at 104 on a lug of the block 32 and is urged by a spring 106 into a locking position in which the aperture 100 binds on the push-rod 80 in the manner of a bar lock. For releasing the lock, a bar 108 is mounted for pivotal movement on lugs of the block 32, said bar carrying four adjustable stop screws 110 each of which can engage with one of the plates 98. For pivoting the bar 108, a piston-and-cylinder arrangement 112 is mounted on the block 32 and acts through a link 114 connecting the piston rod 116 thereof with said bar.

Carried on a depending portion of each block 96 is a bracket 118 supporting a piston-and-cylinder arrangement 56 a piston rod 58 of which is pivotally connected to a lever 60 pivoted, intermediate its length, on a rearward end of its associated push-rod 80, and connected by a pin-and-slot connection at its other end to the mounting 70 on the rearward end of its associated push-rod 34.

The machine in accordance with the invention also comprises lasting band means comprising a first band 128' which extends over the two most heelwardly disposed pairs of lasting elements 46, and two further bands 128" one associated with each of the other pairs of lasting elements 46. The bands are connected by clamp plates 130 to upper surfaces of the arms 44 by which the lasting elements 46 associated with the bands are carried, and each band extends over the inwardly facing end face of its associated lasting elements 46 and the inwardly facing face of its associated pad(s) 72. The lower end of each band is connected by springs 132 to a bracket 134 mounted on the lower end of the plate 78. The spring 132 merely serve to control the lower end of the bands but do not affect the function of the bands, to be hereinafter described.

In the operation of the machine, when in a rest condition the lasting elements 46, under the action of their associated cylinders 66, are in a first, raised, condition in which they are spaced above the plane of the last bottom; in addition, the lasting elements 46 and the clamp pads 72, are in a retracted position, as shown in FIG. 1. When a shoe to be operated upon has been placed on the last support 10, piston-and-cylinder arrangements 84 are actuated to cause the clamp pads, and thus the lasting elements 46 therewith, to be moved inwardly towards the last support until the clamp pads, independently of one another, are pressing their associated bands into contact with the shoe upper. As the clamp pads are moved into pressing engagement with the bands as aforesaid, they are free to pivot, independently of one another, each about the axis of its pin 136, so that the surface of each pad, through which surface pressure is applied as aforesaid, engages, over substantially the whole of its width, its associated band. The pressure applied by the pads is in the order of 1.4 kgf/sq. cm. (20 lbs./sq. in.). In this position, piston-and-cylinder arrangement 112 is deactuated and the bar lock is applied, the clamp pads now being locked in said position. At this stage, the lasting elements 46 are still in their first, raised, condition. Thereafter, piston-and-cylinder arrangements 56 are actuated whereupon, through their associated levers 60, the pivots of which on the push-rods 80 are now stationary, the push-rods 34, and thus the lasting elements 46 are moved inwardly relative to the clamp pads, and at the same time piston-and-cylinder arrangements 66 are actuated to cause the lasting elements 46 to be moved downwardly to a second, operative, condition in which the pressure-applying surface 52 of each lasting element 46 can engage the shoe through its associated band 128' (128''). The inward movement of the elements 46 under the action of the cylinder 56 is limited by engagement of the forward face of the block 36 with the plate 78; the distance through which the elements 46 can move inwardly relative to the pads 72, is of the order of 50 mm.

The effect of the inward and downward movement of the lasting elements 46 is to cause the bands 128' (128'') associated therewith to be drawn relative to the pads 72 heightwise of the last and about the featherline region thereof. To this end, the pressure applied by the pads is sufficient to hold the bands in pressing engagement with the upper while allowing such slippage to take place, and further the surface of each band engaging the upper is such that it can apply a frictional drafting force to the upper while the surface of the pad 72 is coated with a low-friction coating, e.g. polytetrafluoroethylene, so that the band can readily slip relative thereto.

Also during the inward and downward movement of the lasting elements 46, because of the action of the springs 50 in urging the elements counterclockwise (viewing FIG. 2) about the pins 48, the pressure-applying surface 52 of each element is brought into early engagement, along its length, with the feather edge of the shoe bottom, through its associated lasting band, and after such engagement is progressively caused to pivot, in a clockwise direction (viewing FIG. 2) about its pin 48 until it reaches its second condition in which it overlays the lasting marginal portion of the upper and serves to press them against corresponding marginal portions of the insole. This progressive action of each lasting element 46 has an "ironing" effect on the marginal portions of the upper.

It will be appreciated that the material of the lasting bands should not be significantly stretchy for this function, while being relatively flexible so as to conform to the shape of the shoe being operated upon. It has been found that a suitable material is a polyurethane having a Shore A hardness in the range of 70 to 90 and a modulus not less than 850 p.s.i. at 100% elongation (as per the ASTM test procedure). Furthermore, each band has a thickness in the range of 1.5 to 3.0 mm. (1/16 to ⅛ ins.).

When all the lasting elements 46 have reached their second condition, and are in pressing engagemenet with the shoe bottom, a bedding pressure can be applied thereby to the wiped-over lasting marginal portions of the upper, and to this end the fluid pressure control circuit of the machine is arranged so that the piston-and-cylinder arrangements 66 can be supplied with pressure fluid at two different pressures. Furthermore, when bedding pressure is applied, the piston-and-cylinder arrangements 112 of each assembly is again actuated, thereby releasing the bar lock arrangement against the action of the springs 106, whereupon the action of the piston-and-cylinder arrangements 56 is effective to cause the levers 60 to pivot about their pin-and-slot connection with the mountings 70 to cause a small withdrawal movement of the push-rods 80 away from the last support, and thus of the clamp members 72, thereby discontinuing their pressing of the bands against the upper. In this way, the bands 128', 128'' and clamp members 72, do not interfere with the application of bedding pressure to the shoe bottom.

The machine in accordance with the invention also comprises selector means whereby any one pair of lasting elements 46 can be rendered inoperative. In the arrangement described above, namely wherein the two most heelwardly disposed pairs of lasting elements 46 have a single band 128', it is envisaged that the selector means will not be utilized to render inoperative either one of said pairs. (Should it be necessary, for a particular shoe, to render one of said pairs inoperative, then it would also be necessary to exchange two separate bands 128'' for the single band described above.) If, on the other hand, it is expected that the third pair (counting from the heel end) of lasting elements will also not be rendered inoperative, then a single band may be provided in the machine in accordance with the invention covering all three heelwardly disposed pairs of lasting elements 46. Of course, if desired, also a single band may be utilized covering all four pairs of lasting elements. In the latter cases, the bands 128'' associated with each of the third and fourth pairs, or with the fourth pair respectively, will of course be dispensed with.

Having thus described our invention and which we claim as new and desire to secure as Letters Patent of the United States is:

1. A shoe upper conforming machine for use in lasting side portions of shoe upper comprising:

a support for a shoe last on which an upper, the side portions of which are to be lasted, and an insole are positioned; and a pair of side lasting assemblies arranged so as to act on opposite side portions of an upper positioned on a last supported by said support, wherein each side lasting assembly comprises clamping means, comprising a plurality of clamp members movable independently towards the last support to cause a side portion of the upper to be held against the last, on which it is positioned and which is supported by the last support, at localities spaced from the featherline thereof; and lasting band means comprising at least one upper-engaging band portion of flexible sheet material arranged to be interposed between the shoe upper and the clamp members, the or each upper-engaging band portion being held by the clamp members, in the operation of said machine, against the upper positioned on its last under a pressure which does not prevent movement of the upper-engaging band portion(s) relative to the clamp members but which is sufficient to cause such movement of said portion(s) to apply a drafting force to the portion of the upper engaged thereby, the arrangement being such that, in the operation of the machine, a drafting force is applied to the upper by said portion(s) heightwise of the last in the direction of the featherline of the shoe and lasting marginal portions of the upper are caused to be wiped over corresponding marginal portions of the insole and be pressed thereagainst, wherein each clamp member is mounted for pivotal movement about an axis extending heightwise of the last.

2. A shoe upper conforming machine as recited in claim 1 wherein each side lasting assembly further comprises lasting element means, comprising a plurality of lasting elements arranged side-by-side and movable inwardly towards the last support so as to cause lasting marginal portions of the side portion of the upper to be wiped over corresponding marginal portions of the insole and be pressed thereagainst, the inward movement of the lasting elements towards the last support as aforesaid being effective to cause movement of the upper-engaging band portions to take place relative to the clamp members whereby a drafting force is applied to the upper by said portions heightwise of the last as aforesaid, and wherein the or each band portion is interposed as aforesaid between the upper and not less than two adjacent lasting elements.

3. A shoe upper conforming machine for use in lasting side portions of shoe uppers comprising:

a support for a shoe last on which an upper, the side portions of which are to be lasted, and an insole are positioned;

a pair of side lasting assemblies arranged so as to act on opposite side portions of an upper positioned on a last supported by said support, wherein each side lasting assembly comprises lasting element means, comprising a plurality of lasting elements arranged side-by-side and movable inwardly towards the last support so as to cause lasting marginal portions of the side portion of the upper to be wiped over corresponding marginal portions of the insole and be pressed thereagainst; and lasting band means of flexible sheet material held under tension by resilient means and arranged to be interposed between the shoe upper and the lasting elements, the arrangement being such that as inward movement of the lasting elements towards the last support is effected as aforesaid, the lasting band means is drawn heightwise of the last, in a direction of the featherline thereof, and also about the featherline region, thus to assist in wiping the lasting marginal portions of the upper over corresponding marginal portions of the insole and in pressing them thereagainst, wherein the last band means of each side lasting assembly comprises at least one upper-engaging band portion, and wherein the or each band portion is interposed as aforesaid between the upper and not less than two adjacent lasting elements.

4. A shoe upper conforming machine as recited in claim 3 wherein said lasting elements of said lasting element means are arranged in pairs, each pair having associated therewith a clamp member;

said machine also comprising operator-actuatable selector means whereby any one pair of lasting elements and its associated clamp member may be rendered inoperative, and wherein one band portion of the lasting band means is associated with each pair of lasting elements.

5. A shoe upper conforming machine as recited in claim 3 wherein the lasting elements of the lasting element means are arranged in pairs, each pair having associated therewith a clamp member, and further wherein the lasting band means comprises a single band portion extending across the width of the two most heelwardly disposed pairs of lasting elements.

6. A shoe upper conforming machine as recited in claim 5 wherein one end of the or each band portion is connected to its associated lasting elements so that inward movement of the lasting element means as aforesaid is effective to draw the lasting band portion(s) heightwise of the last and inwardly over the feather region thereof as aforesaid.

* * * * *